United States Patent [19]

Ihlenburg

[11] Patent Number: 4,689,901

[45] Date of Patent: Sep. 1, 1987

[54] REDUCED TORSION RESISTANCE ATHLETIC SHOE SOLE

[76] Inventor: Frederick Ihlenburg, 1440 Chandler Rd., Lake Oswego, Oreg. 97034

[21] Appl. No.: 662,894

[22] Filed: Oct. 19, 1984

[51] Int. Cl.[4] ..... A43B 5/00

[52] U.S. Cl. ..... 36/126; 36/114; 36/59 C

[58] Field of Search ..... 36/114, 126, 127, 128, 36/129, 134, 59 C, 59 R

[56] References Cited

U.S. PATENT DOCUMENTS

| | | | |
|---|---|---|---|
| 1,422,716 | 7/1922 | Jones | 36/127 X |
| 1,876,195 | 9/1932 | Youmans | 36/127 X |
| 3,466,763 | 9/1969 | Levin | 36/126 X |
| 3,707,047 | 12/1972 | Nedwick | 36/114 X |
| 3,739,497 | 6/1973 | Cameron | 36/114 X |
| 4,167,071 | 9/1979 | Koransky | 36/127 |
| 4,327,503 | 5/1982 | Johnson | 36/129 X |
| 4,347,674 | 9/1982 | George | 36/126 |
| 4,577,422 | 3/1986 | Tanel | 36/126 |
| 4,578,882 | 4/1986 | Talarico, II | 36/103 |

*Primary Examiner*—Stephen Marcus
*Assistant Examiner*—T. Graveline
*Attorney, Agent, or Firm*—Cushman, Darby & Cushman

[57] ABSTRACT

A shoe sole for enhanced turning traction and release characteristics with an instep and an out step and further having a toe section and a heel section, the toe section bearing from two to a plurality of downwardly asymmetrically extending vacuum limiting traction arrays. Toe traction arrays are of generally circular basis, generally concentric with a point in a vertical axis with the balance point of the shoe sole and with the asymmetric extension from a plane comprising the shoe sole affording greater angle to the instep than the out step. This differential of angle allows improved turning characteristics with less turning strain for the wearer. In a further aspect of the invention, the heel section of the shoe bears vacuum limiting traction arrays to enhance the traction characteristics of the shoe when the shoe sole is applied generally flush with the traction surface.

11 Claims, 3 Drawing Figures

REDUCED TORSION RESISTANCE ATHLETIC SHOE SOLE

BACKGROUND OF THE INVENTION

The present invention relates to shoe soles and more particularly to novel gripping traction arrays on athletic shoe soles for use on natural and synthetic turf-type playing surfaces.

The advent of synthetic playing surfaces for soccer, football and other sports previously played solely on natural turf has brought about a concomitant increase in the injury to athletes, especially knee and ankle injuries. Knee and ankle injuries suffered on synthetic surfaces have been attributed primarily to the inadequate tractive and releasing capability of shoe soles employed by athletes. Attempts to adapt traction soles previously used on natural playing surfaces for use on synthetic playing surfaces have met with some success, but in general have been unsatisfactory as the number of injuries on synthetic surfaces attributable at least in part to inadequately designed traction soles has continued to grow with increased usage of synthetic playing surfaces. An example of this is U.S. Pat. No. 4,096,649 the teachings of which have been incorporated by reference.

Consequently, it is a broad object of the present invention to provide an improved traction-type athletic shoe sole for use on synthetic playing surfaces of the type intended to simulate natural turf surfaces and at the same time to provide an improved traction-type athletic shoe sole that is adaptable for use on natural playing surfaces. Another broad object of the present invention is to provide a traction-type athletic shoe sole that will substantially reduce the athlete injury rate, especially on synthetic playing surfaces, that has previously been attributed to inferior traction soles. Additional objects of the present invention are to provide a traction-type shoe sole for athletic shoes that will allow relatively free rotation of the shoe on a playing surface about an upright axis running through the ball of an athlete's foot (balance point) while providing good traction on the surface for the athlete, thereby allowing torsional movement of the shoe on the playing surface while maintaining sufficient traction to prevent an athlete from slipping or falling; to provide a traction-type shoe sole that will improve the turning and cutting ability of an athlete when running on a synthetic playing surface, that is, to provide a traction-type shoe sole that will maintain traction on the playing surface while allowing the athlete to quickly change his direction of movement and at the same time provide the athlete with necessary rotational freedom relative to the playing surface, thereby reducing the possibility of injury to the ankle or knee; to provide a traction-type shoe sole that will maintain a traction sufficient contact with the playing surface even though the athlete's foot may be turned at an angle sidewardly relative to the plane of the playing surface; and, to provide a traction-type shoe sole having traction arrays that are safer and more efficient for the wearer of the athletic shoe bearing said shoe sole as well as being unlikely to cause severe injury to those others on the playing field that might have the misfortune of coming into physical contact with the traction arrays.

SUMMARY OF THE INVENTION

In accordance with the foregoing objects and other objects that will become apparent to one of ordinary skill after reading the following specification, the present invention provides a shoe sole having a heel section and a toe section with the interior lateral portion of the toe section being the instep and the exterior lateral portion of toe section being the out step.

A shoe sole for enhanced turning and traction and release characteristics with an instep and an out step having a toe section and a heel section, the toe section bearing from one to a plurality of downwardly asymmetrically extending vacuum limiting traction arrays. The traction arrays are of generally circular basis, generally concentric with a point in a vertical axis with the balance point of the shoe sole and wherein the asymmetric extension from a plane comprising the shoe sole and affording greater angle to the instep than the out step providing improved turning characteristics with less turning strain for the wearer.

BRIEF DESCRIPTION OF THE DRAWINGS

A better understanding of the present invention can be derived from reading the ensuing specification in conjunction with the accompanying drawings wherein.

DETAILED DESCRIPTION

Figure 1:
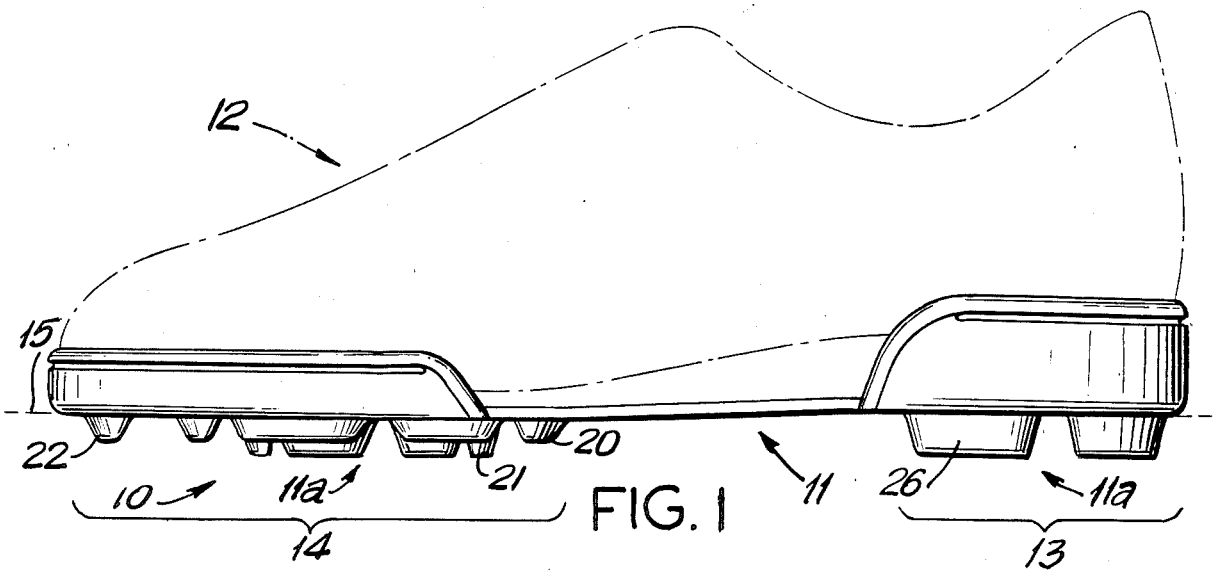
FIG. 1 is a side elevation of the shoe sole of the present invention with a shoe upper shown in phantom outline.
Figure 2:
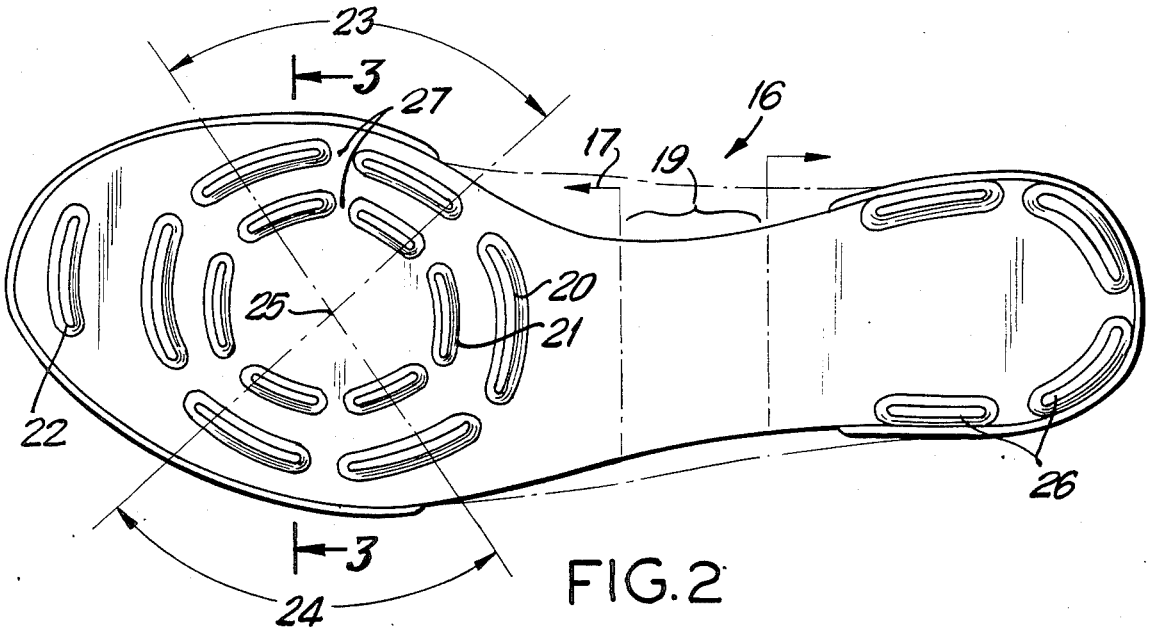
FIG. 2 is a bottom view of the shoe sole of the present invention.

Referring first to FIG. 1, the athletic shoe sole 10 of the present invention is adapted for attachment to an athletic shoe 12 of generally conventional configuration, and can be adapted to any other type of shoe as required. The particular athletic shoe depicted in FIGS. 1 through 3 can be used on both natural playing surfaces, such as sod, or on synthetic playing surfaces such as one of the commercially available synthetic turf surfaces used to imitate natural sod. The shoe sole has an upper, plate-like base portion 11 from which vacuum limiting traction arrays 20, 21, 22 and 26 on heel section 13 and toe section 14 depend. The lower surface of the plate-like portion defines the primary plane 15. FIG. 2 depicts a shoe sole 16 of generally conventional outline, with a laterally enlarged toe section 17 having a rounded forward end and a laterally enlarged heel section 18 with a rounded rearward end. The arch portion 19 of the shoe sole intermediate the heel section and the toe section has a reduced width to accommodate the normal shaping of an athletic shoe upper. The shoe sole is adapted for attachment to a conventional insole or can be adapted for direct attachment to the shoe upper.

Traction is supplied by downwardly extending vacuum limiting traction arrays 20, 21, 22 and 26.

Downwardly from the primary plane of the shoe sole extend the traction arrays that cause this shoe sole to be unique. These traction arrays afford improved traction in any direction to a wearer of shoes bearing such soles. Yet while affording traction in any direction, direction may be instantly altered with minimal strain on wearers ankles and knees.

Traction arrays 20 and 21 are asymmetrical. The asymmetry in the traction array lies in the differential downward extension of a traction array from the instep side 23 of the sole as opposed to the out step side 24. Extension of a traction array is measured from the shoe sole itself with the surface of the shoe sole forming the primary plane. In some embodiments the surface of the shoe sole may not be the normal surface parallel to the wearer's foot, however as understood herein the "primary plane" of the sole will be one parallel to that of the wearer's foot.

Traction arrays present in this unique shoe sole both for heel and toe sections are downwardly extending aspects from the base surface of the shoe sole. Each traction array for a toe section is of a generally circular basis in that an array is generally an assemblage of arcuate sections which unto a particular array would describe generally a circle where sufficient arcuate sections assembled. For example in FIG. 2 note that traction arrays 20 and 21 are each generally circular. 22 is a traction array also of a general circular basis but only a single arcuate section is present. Extreme elipses, linear arrays and other forms not of a generally circular nature will not be suitable in the toe section.

Similarly note in FIG. 2 the concentric positioning of traction arrays 20, 21, and 22. These are concentric with each other, and concentric with 25, a point in vertical axis the balance point of the shoe sole.

The balance point of the shoe sole is based upon that area of the wearer's foot about which such a wearer would likely turn while rapidly changing direction.

Obviously one may turn ones foot to change direction on any point from heel to toe. However in high speed activity, such as athletic activity, (e.g., soccer or football or squash) the optimal area for turning is in an axis generally at the ball of the foot. The instant shoe sole facilitates such turning and does so while maintaining optimal directional traction with minimal rotational resistance, and reduced knee and ankle strain to the wearer.

Turning force required to turn while wearing shoes equipped with a toe section of the traction arrays of the instant invention may be less than ½ of other tread designed shoe soles at a given velocity. At the same time the traction remains quite high. The traction array of the heel section is similar but not of generally circular disposition. FIG. 2, 26 shows a heel section traction array disposed along the external edges of the heel section.

Figure 3:
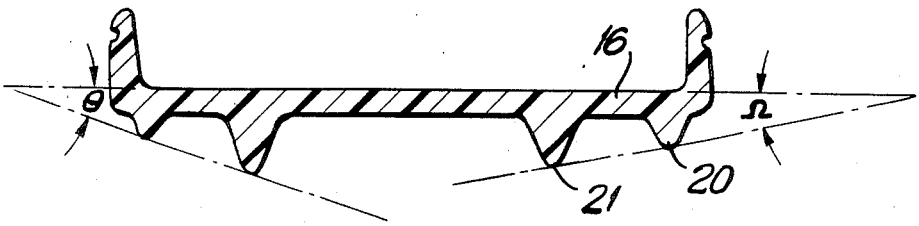
FIG. 3 is a cross-sectional view of the first embodiment taken along section line 3—3 of FIG. 2.

FIG. 3 displays the angle formed by a line from the downward extension of a traction array on the instep side of the toe section of the shoe sole where two traction arrays are present on the instep side of the shoe. A line from the more descending axial traction array to the more peripheral instep portion of a traction array intersecting the primary plane describes the instep angle ($\theta$). Similarly, looking to a line to the out step portion of the shoe from the out step portion of the traction arrays to the primary plane the out step angle ($\Omega$) is described.

In the toe section of the shoe sole of the present invention $\theta$ must be greater than $\Omega$.

The vacuum limiting aspect is unique to the structure of the traction arrays. Creation of a vacuum or suction or reduced pressure area between a shoe sole and a ground surface will at the least require extra force to lift the sole and potentially greatly retard the rate of movement and reduce agility. In view the requirement of the traction arrays being both generally circular and extended from the primary plane, vacuum limitation is a potential problem. This has been avoided by forming traction arrays as segmented assemblies, thus limiting vacuum formation in the toe section. FIG. 2 shows traction arrays 20 and 21 to be assemblies of arcuate sections, separated by vent spaces 27. Traction array 22 being only one arcuate section is of itself vacuum limiting.

Vacuum limitation in heel section traction arrays is similarly provided for. FIG. 2, 26 shows a traction array of segments with vacuum limitation in the traction array not completely enclosing an area yet providing traction in all directions with a flat footed or heel down stance by the wearer.

At the heel the traction array is of concern in a flat footed stance by the wearer of such sole. Particularly firm traction by heel as well as the toe being in contact with the ground will cooperatively compensate for any reduced linear traction resulting from the generally circular toe traction array.

Multiple configurations of toe section traction arrays may be designed in keeping with this invention maintaining vacuum limitation and general circularity oriented around the balance point.

When generally continuously circularly disposed, segments of a traction array should be generally about 1.2 to 6 cm in length separated generally by at least about 0.2 or more cm with a preferred segment length of generally about 1.9 to 3.9 cm with at least about 0.3 cm or greater spacing.

When multiple toe traction arrays are present the instep and out step angles will be formed by the line drawn from the furthest extending traction arrays and the next most extending traction array to the instep and out step sides respectively intersecting the primary plane.

In the practice of this invention the instep angle is preferred to be from about 5° to 15° greater than the out step angle. In a preferred embodiment the instep angle is from 5° to 20° and the out step angle from 3° to 13°, with a minimum of about 5° differential. In a most preferred embodiment the instep may be 14° to 16° and the out step may be 4° to 8°.

An also preferred embodiment of the shoe sole employs the 5° to 20° instep angle and most preferably an instep angle of 14° to 16° formed by the asymmetrically downwardly extending vacuum limiting traction arrays with any suitable out step and heel section, the foregoing being a most desirable contact angle for an athletic shoe.

In a particular embodiment the shoe sole may be of an almost cresent cross section allowing an easy transition from the instep angle to the out step angle avoiding any great peaks of energy in rotating the ankle from instep to out step while in contact with the ground.

The shoes soles of the present invention can be manufactured from a variety of synthetic materials. A preferred material from which a shoe sole for use on natural turf can be manufactured is an elastomeric polyvinyl chloride having a Shore Durometer hardness of about 92 as to the traction arrays and about 65–75 as to the base of the shoe sole. For a shoe sole adapted for use on synthetic turf and hard, icy fields a silicated plastisol can be used. Such plastisol consists of sharp silica aggregate added to a base material such as the polyvinyl chloride suggested above.

After reading the foregoing specification, one of ordinary skill in the art will be able to effect various changes, substitutions of equivalents and other alterations without departing from the spirit of the invention, and general concepts disclosed. For example a wide variety of heel section traction arrays or generally circular toe section traction arrays may be desired in different athletic situations. Different modes of vacuum limitation may easily be devised. The invention will be limited only by the claims.

What is claimed is:

1. A shoe sole having a bottom face, instep, out step and toe portions, said toe portion including a plurality of vacuum limiting traction elements depending from the bottom face and arranged in a generally circular fashion about a point in a vertical axis at the balance point of the shoe sole, said depending elements including a first set more axially disposed, a second set more peripherally positioned adjacent the instep side of the toe portion and a third set more peripherally positioned adjacent the out step side of the toe portion, said first, second and third sets respectively depending first, second and third distances from said bottom face, wherein said first distance is greater than said third distance with the latter being greater than said second distance so that the bottoms of said first and second sets define an instep angle relative to said bottom face and the bottoms of said first and third sets define an out step angle relative to said bottom face with said instep angle being greater than said out step angle.

2. The sole of claim 1, wherein the instep angle varies from about 5° to about 15° greater than the out step angle.

3. The sole of claim 1, wherein the instep angle varies from about 5° to about 20° and the out step varies from about 3° to about 13°.

4. The sole of claim 3, wherein the preferred instep angle varies from about 14° to about 16° and the preferred out step angle varies from about 4° to 8°.

5. The sole of claim 1, wherein the toe section includes two to four downwardly asymmetrically extending vacuum limiting traction arrays.

6. The sole of claim 1, wherein the traction elements are comprised of a plurality of segments having a generally circular form and a length varying from about 1.2 to about 6 cm with the segments being separated from one another by generally about 0.2 cm or more.

7. The sole of claim 6, wherein the segments have a length varying from about 1.9 to about 3.9 cm in length with about 0.3 cm or greater spacing.

8. The sole of claim 1, further including a heel section comprised of a number of downwardly extending vacuum limiting traction elements.

9. The sole as in claim 8, wherein the heel section elements are comprised of a plurality of heel segments having a length varying from about 1.2 to about 6 cm with the heel segments being separated from one another by generally about 0.2 or more cm.

10. The sole of claim 9, wherein the heel segments have a preferred length varying from about 1.9 to about 3.9 cm with about 0.3 cm or greater spacing therebetween.

11. The sole as in claim 9, wherein the heel segments are disposed along the peripheral edges thereof.

* * * * *